US011285358B2

(12) United States Patent
Erb

(10) Patent No.: US 11,285,358 B2
(45) Date of Patent: Mar. 29, 2022

(54) EXERCISE DEVICES EMPLOYING GRIPPING HANDLES

(71) Applicant: Mark Erb, Menomonie, WI (US)

(72) Inventor: Mark Erb, Menomonie, WI (US)

( * ) Notice: Subject to any disclaimer, the term of this patent is extended or adjusted under 35 U.S.C. 154(b) by 43 days.

(21) Appl. No.: 16/874,321

(22) Filed: May 14, 2020

(65) Prior Publication Data

US 2021/0353995 A1 Nov. 18, 2021

(51) Int. Cl.

| | |
|---|---|
| ***A63B 21/00*** | (2006.01) |
| ***A63B 21/062*** | (2006.01) |
| *A63B 23/02* | (2006.01) |

(52) U.S. Cl.

CPC ..... *A63B 21/4019* (2015.10); *A63B 21/062* (2013.01); *A63B 21/154* (2013.01); *A63B 21/4035* (2015.10); *A63B 23/0211* (2013.01); *A63B 2208/0233* (2013.01)

(58) Field of Classification Search

CPC ..... A63B 21/4019; A63B 21/154; A63B 21/4035; A63B 21/062; A63B 23/0211; A63B 2208/0233; B65D 25/2873; B65D 25/2876; B65D 63/18; A45C 13/30; A45C 2013/303; A45C 2013/306; A45F 5/10; A45F 2005/1006; A45F 2005/1013; A45F 2005/1053; A45F 2005/006

See application file for complete search history.

(56) References Cited

U.S. PATENT DOCUMENTS

| | | | | |
|---|---|---|---|---|
| 5,050,869 | A * | 9/1991 | Frate | A63B 21/154 482/94 |
| 5,090,691 | A * | 2/1992 | Pollock | A63B 21/151 16/426 |
| 2007/0042878 | A1* | 2/2007 | Lundquist | A63B 21/06 482/99 |
| 2008/0261788 | A1* | 10/2008 | Blount | A63B 21/4019 482/139 |
| 2010/0199926 | A1* | 8/2010 | McCullough | A01K 27/003 119/795 |
| 2013/0288861 | A1* | 10/2013 | Cole | A63B 23/1263 482/102 |
| 2014/0315695 | A1* | 10/2014 | Scott | A61H 1/0274 482/91 |
| 2020/0023228 | A1* | 1/2020 | Yang | A63B 1/00 |
| 2020/0086173 | A1* | 3/2020 | Marti | A63B 21/4043 |
| 2020/0114195 | A1* | 4/2020 | Henniger | A63B 21/0552 |

* cited by examiner

*Primary Examiner* — Joshua Lee
*Assistant Examiner* — Catrina A Letterman

(57) ABSTRACT

The present invention is directed to a gripping handle that tightens to a hand when pulling force is applied and loosens from the hand when pulling force is not applied. The gripping handle may comprise a dowel, a first and second loop, an attachment point, and a flexible connector running from the attachment point, through the first loop, along the dowel, through the second loop, and back to the attachment point. A portion of the flexible connector running along the dowel may loop over a hand gripping the dowel and may tighten to the hand when the dowel is pulled on. The flexible connector may loosen from the hand when the dowel is no longer being pulled. The present invention additionally features an exercise device comprising the gripping handle attached by a cord running through a pulley component to a weight.

9 Claims, 8 Drawing Sheets

EXERCISE DEVICES EMPLOYING GRIPPING HANDLES

FIELD OF THE INVENTION

The present invention is directed to a gripping handle that tightens to or loosens from a hand depending on the pulling force applied to said handle, and exercise devices employing said handle.

BACKGROUND OF THE INVENTION

Presently existing handles, such as those used in exercise devices, can be difficult for people with physical complications to grip. This difficulty is only increased when said handles are attached to a heavy object, such as a weight. Therefore, a present need exists for a handle that grips to the hand in order to aid in pulling heavy objects.

For people with physical complications, such as obesity, it can be difficult to stretch out one's body and to do certain exercises, such as sit-ups. Therefore, a present need exists for an exercise device that employs a gripping handle and allows for a person to stretch from a supine position and aids in certain exercises, such as sit-ups.

BRIEF SUMMARY OF THE INVENTION

It is an objective of the present invention to provide devices that allow for a handle that tightens to or loosens from a hand depending on the pulling force applied to said handle, as specified in the independent claims. Embodiments of the invention are given in the dependent claims. Embodiments of the present invention can be freely combined with each other if they are not mutually exclusive.

The present invention features a gripping handle for use in exercise devices. The gripping handle may comprise a dowel with a loop on either end. The gripping handle may further comprise an attachment point and a flexible connector that runs from the attachment point, through the first loop, along a side of the dowel, through the second loop, and back to the attachment point. A portion of the flexible connector running along the side of the dowel may loop over a hand gripping the dowel, tighten to the hand when the dowel is pulled, loosen from the hand when the dowel is no longer being pulled. The gripping handle may be scaled to be held with one hand or two hands.

The present invention additionally features an exercise and supine stretching device that utilizes the aforementioned gripping handle. The exercise and supine stretching device may comprise a gripping handle connected to a first end of a cord by an attachment point. The device may further comprise a pulley system attached to a stable surface through which the cord runs through, and a weight attached to a second end of the cord. Pulling on the gripping handle may cause the gripping handle to tighten onto the hand and may cause the weight to lift up. Releasing the gripping handle may cause the gripping handle to loosen from the hand and may cause the weight to descend to the ground. The exercise and supine stretching device may exercise a first arm of a user. The exercise and supine stretching device may include a second set of components to exercise a second arm of a user. The gripping handle of the exercise and supine stretching device may aid in stretching as the gripping handle does not require one to hold on as tightly as a standard handle. The exercise and supine stretching device may provide a variety of benefits, such as rib cage elevation, increasing lung capacity, decompressing an upper thoracic region, and remedying poor posture.

The present invention additionally features a stretching device that utilizes the aforementioned gripping handle. The stretching device may comprise a post having a first loop disposed in a side of the post, a protrusion from the post having a second loop disposed in a side of the protrusion, a gripping handle hanging down from the protrusion by a first end of a cord, and a weight attached to a second end of the cord. The cord may run from the gripping handle, through the second loop, through the first loop, and attach to the weight such that the weight hangs from the cord, is capable of being lifted by pulling downwards on the gripping handle, and is capable of being lowered by releasing the gripping handle. The stretching device may be used by a person sitting in a chair or a wheelchair underneath the protrusion. The gripping handle of the stretching device may aid in stretching as the gripping handle does not require one to hold on as tightly as a standard handle. The stretching device may provide a variety of benefits, such as rib cage elevation, increasing lung capacity, decompressing an upper thoracic region, and remedying poor posture.

The present invention additionally features a yoga/mobile exercise device that utilizes the gripping handle of the present invention. The yoga/mobile exercise device may comprise a chair having a compartment under the seat. The yoga/mobile exercise device may further comprise a first gripping handle attached to two cords running through pulley components disposed on a vertical portion of the chair and attached to weights. Pulling on the first gripping handle may cause both weights to rise. The yoga/mobile exercise device may further comprise a second and third gripping handle attached to elastic components on a side of the chair. Pulling on the second and third gripping handle may cause the elastic components to strain, resulting in a resistance exercise. The yoga/mobile exercise device may further comprise a plurality of back pulley components disposed on a back portion of the yoga/mobile exercise device such that a plurality of cords run through the back pulley components removably attached to gripping handles at a first end of the cord and attached to weights at a second end of the cord. The yoga/mobile exercise device may provide a plurality of different stretches and exercises offered by the gripping handles and their associated components.

One of the unique and inventive technical features of the present invention is the flexible connector that tightens to a hand when pulling force is applied to the gripping handle and loosens from the hand when pulling force is no longer applied to the gripping handle. Without wishing to limit the invention to any theory or mechanism, it is believed that the technical feature of the present invention advantageously provides for aid for the physically compromised in gripping onto the handle in order to pull heavy objects. None of the presently known prior references or work has the unique inventive technical feature of the present invention.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWING(S)

The features and advantages of the present invention will become apparent from a consideration of the following detailed description presented in connection with the accompanying drawings in which.

DETAILED DESCRIPTION OF THE INVENTION

Figure 1:
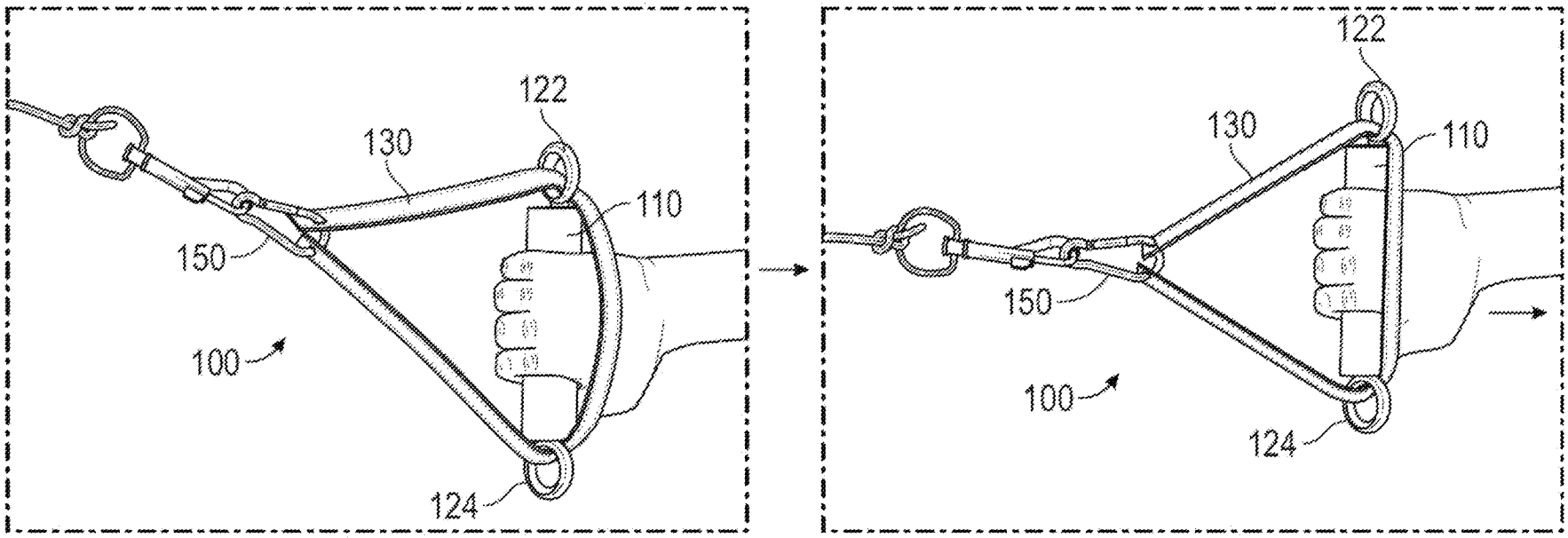
FIG. 1 shows a top view of a gripping handle of the present invention and how the handle applies pressure to a hand when pulled.
Figure 2:
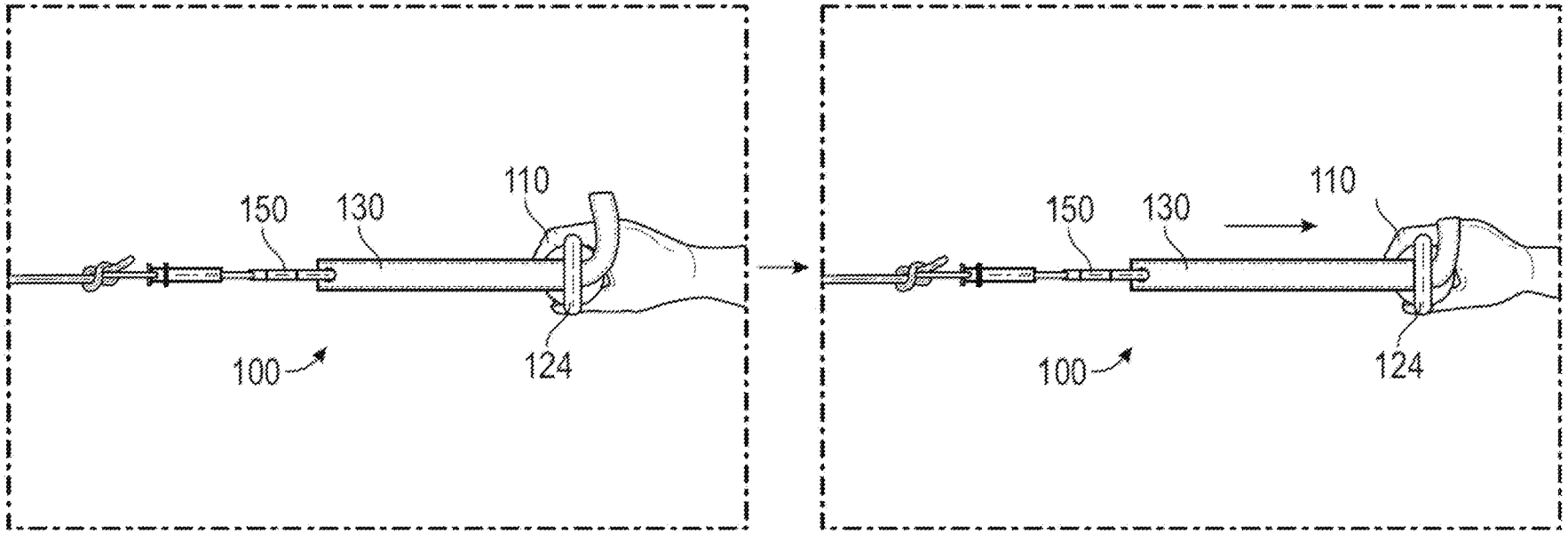
FIG. 2 shows a side view of a gripping handle of the present invention and how the handle applies pressure to a hand when pulled.
Figure 4:
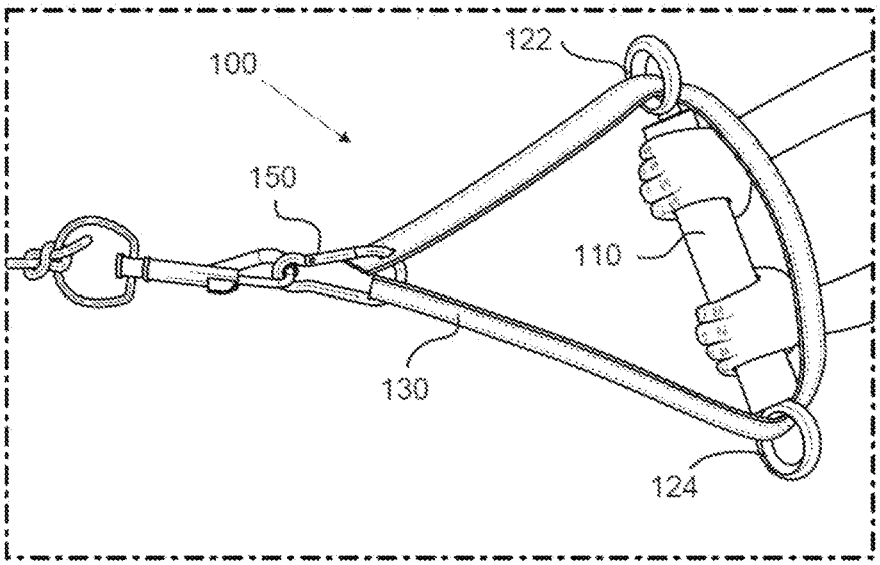
FIG. 4 shows an embodiment of a gripping handle scaled to be held with two hands.

Following is a list of elements corresponding to a particular element referred to herein:

100 gripping handle
110 dowel
122 first loop
124 second loop
130 flexible connector
150 attachment point
200 duplicate gripping handle
300 pulley component
400 duplicate pulley component
500 cord
600 duplicate cord
700 weight
800 duplicate weight
900 stable surface
1100 post
1150 post loop
1200 protrusion
1250 protrusion loop
1300 support
2000 chair
2050 compartment
2100 first yoga/mobile gripping handle
2110 first yoga/mobile pulley component
2120 second yoga/mobile pulley component
2130 first yoga/mobile cord
2140 second yoga/mobile cord
2150 first yoga/mobile weight
2210 first yoga/mobile loop
2220 second yoga/mobile loop
2230 second yoga/mobile gripping handle
2240 third yoga/mobile gripping handle
2250 third yoga/mobile cord
2260 fourth yoga/mobile cord
2270 first elastic component
2280 second elastic component
2310 back pulley components
2320 back cords
2330 back gripping handles
2340 back weights Referring now to FIGS. 1-2, the present invention features a gripping handle (100). In some embodiments, the gripping handle (100) may comprise a dowel (110) having a first end and a second end. The dowel may be 6 to 30 inches in length and 1 to 2 inches in diameter. The gripping handle (100) may further comprise a first loop (122) disposed at the first end of the dowel (110) and a second loop (124) disposed at the second end of the dowel (110). The gripping handle (100) may further comprise an attachment point (150) and a flexible connector (130) running from the attachment point (150), through the first loop (122), along a side of the dowel (110), through the second loop (124), and back to the attachment point (150). A portion of the flexible connector (130) running along the side of the dowel (110) may loop over a hand gripping the dowel (110). This portion of the flexible connector (130) looping over the hand may tighten to the hand when the dowel (110) is being pulled, and may loosen from the hand when the dowel (110) is not being pulled. In some embodiments, the flexible connector (130) may comprise a continuous leather strap. In some embodiments, the attachment point (150) may comprise a clip attached to a cord. In some embodiments, the gripping handle (100) is scaled to be gripped by one hand. In other embodiments, the gripping handle (100) is scaled to be gripped by both hands of a user, as seen in FIG. 4.

Figure 3:
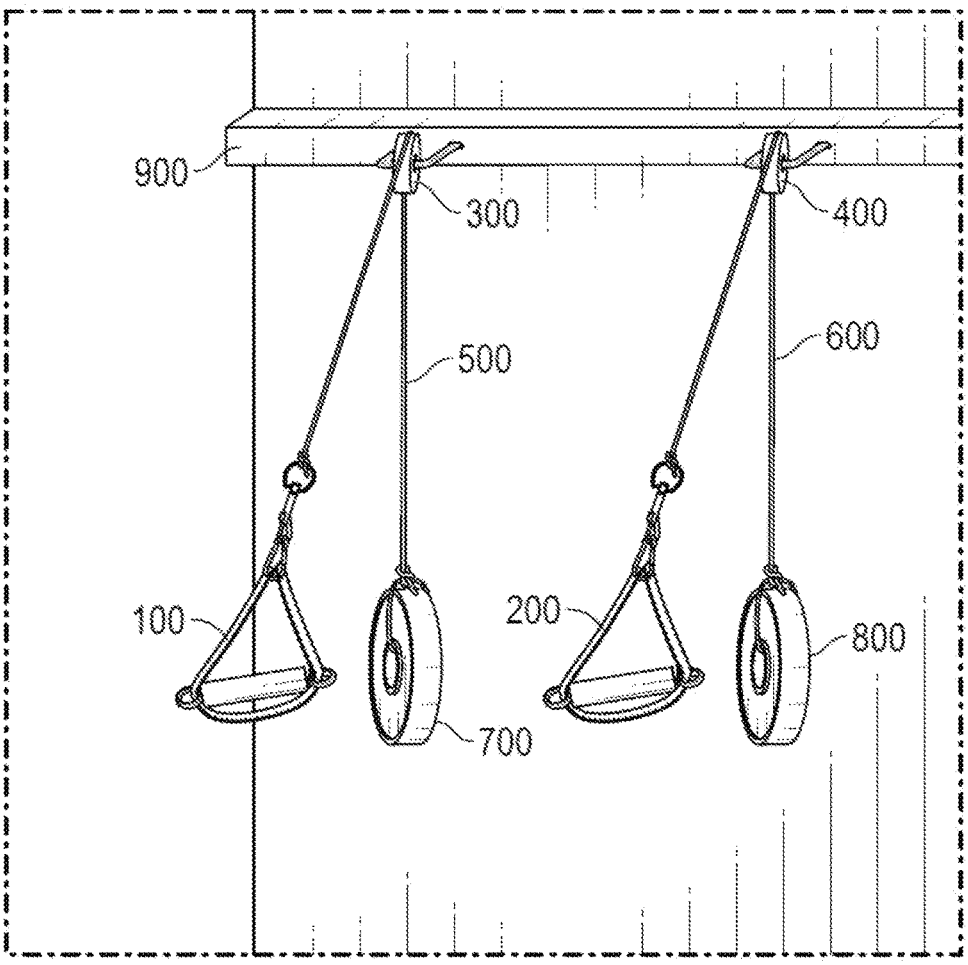
FIG. 3 shows a use case of the gripping handle of the present invention in the form of a stretching and sit-up device.

Referring now to FIG. 3, the present invention features an exercise and supine stretching device. In some embodiments, the device may comprise a gripping handle (100). In some embodiments, the gripping handle (100) may comprise a dowel (110) having a first end and a second end. The dowel may be 6 to 30 inches in length and 1 to 2 inches in diameter. The gripping handle (100) may further comprise a first loop (122) disposed at the first end of the dowel (110) and a second loop (124) disposed at the second end of the dowel (110). The gripping handle (100) may further comprise an attachment point (150) and a flexible connector (130) running from the attachment point (150), through the first loop (122), along a side of the dowel (110), through the second loop (124), and back to the attachment point (150). A portion of the flexible connector (130) running along the side of the dowel (110) may loop over a hand gripping the dowel (110). This portion of the flexible connector (130) looping over the hand may tighten to the hand when the dowel (110) is being pulled, and may loosen from the hand when the dowel (110) is not being pulled. In some embodiments, the flexible connector (130) may comprise a continuous leather strap. In some embodiments, the attachment point (150) may comprise a clip attached to a cord. In some embodiments, the gripping handle (100) is scaled to be gripped by one hand. In other embodiments, the gripping handle (100) is scaled to be gripped by both hands of a user. The exercise and supine stretching device may further comprise a pulley component (300) connected to a stable surface (900). The exercise and supine stretching device may further comprise a cord (500) having a first end and a second end connected to the attachment point (150) of the gripping handle (100) at the first end of the cord (500) and running through the pulley component (300). The exercise and supine stretching device may further comprise a weight (700) connected to the second end of the cord (500). The weight (700) may be pulled upwards by pulling on the gripping handle (100). In some embodiments, the stable surface (900) may comprise a platform. In some embodiments, the exercise and supine stretching device may further comprise a duplicate gripping handle (200), a duplicate pulley component (400), and a duplicate cord (600) having a first end and a second end. The first end may connect to the duplicate gripping handle (200) at a duplicate attachment point (250), and the duplicate cord (600) may run through the duplicate pulley component (400). The exercise and supine stretching device may further comprise a duplicate weight (800) connected to the second end of the duplicate cord (600). The duplicate weight (800) may be pulled upwards by pulling on the duplicate gripping handle (200). The duplicate pulley component (400) may connect to the stable surface (900). In some embodiments, the gripping handle (100) may be held by a first hand and the duplicate gripping handle (200) may be held by a second hand. The exercise and supine stretching device may be used for stretching a user's back in a supine position by gripping the gripping handle (100) in a first hand and the duplicate gripping handle (200) in a second hand over one's head and allowing the weight (700) and the duplicate weight (800) to hang on the cord (500) and the duplicate cord (600), respectively. The exercise and supine stretching device may be used for sit-up exercises by gripping the gripping handle (100) with a first hand and the duplicate gripping handle (200) in a second hand, and using the hanging weight (700) and duplicate weight (800) as counterweights to aid in pulling oneself up from a supine position to an upright position. The gripping handle (100) of the exercise and supine stretching device may aid in stretching as the gripping handle (100) does not require one to hold on as tightly as a standard handle. Use of the exercise and supine stretching device may provide a variety of benefits, such as rib cage elevation and increased lung capacity, both of which are useful for combating respiratory diseases. Use of the exercise and supine stretching device may further provide decompression of nerves in an upper thoracic region (e.g. T3 nerve roots) to further aid lung health. Use of the exercise and supine stretching device may further provide core stretches, which is useful in remedying posture issues.

Figure 5:
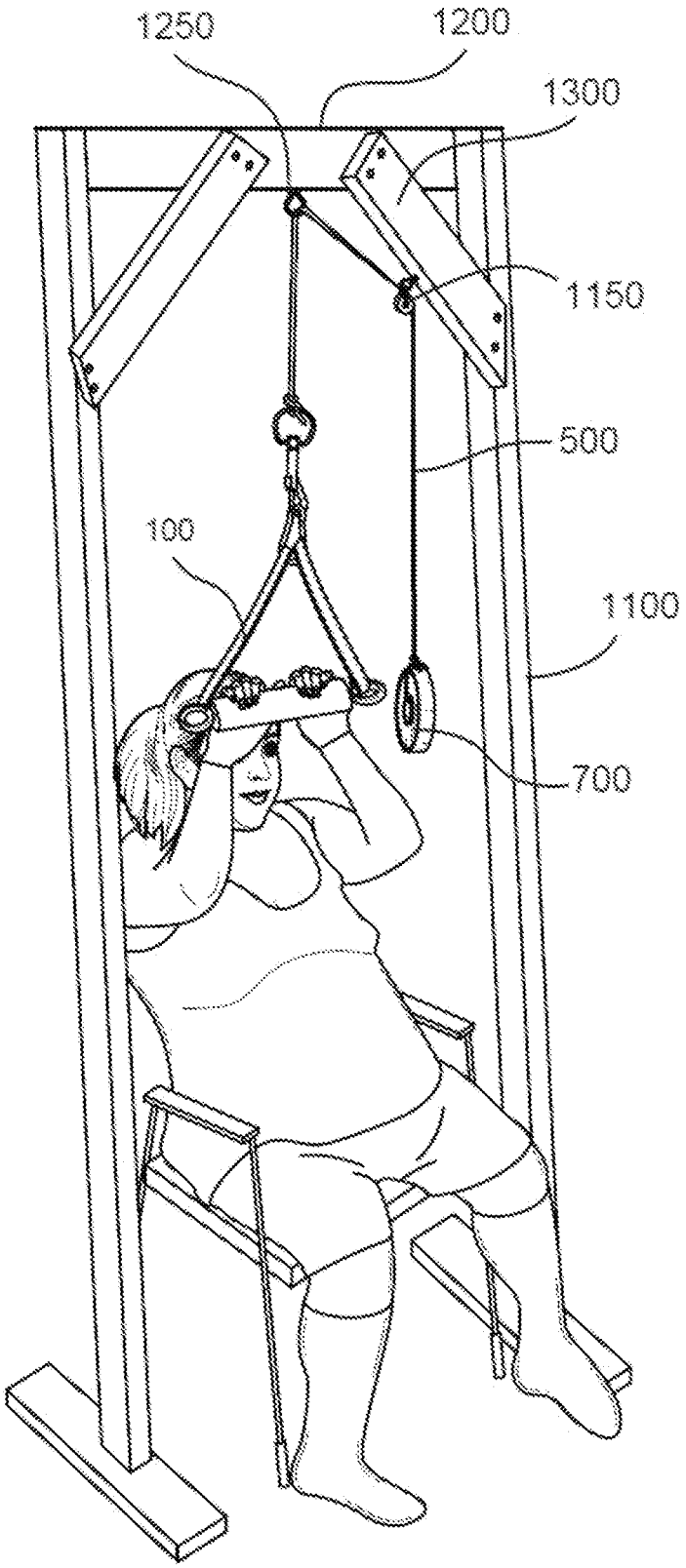
FIG. 5 shows a use case of the gripping handle of the present invention in the form of a wheelchair stretching device.

Referring now to FIG. 5, the present invention features a stretching device. The stretching device may comprise a post (1100) having a first cord loop (1150) disposed in a side of the post (1100). The stretching device may further comprise a protrusion (1200) from the post (1100) having a second cord loop (1250) disposed in a side of the protrusion (1200). In some embodiments, the stretching device may further comprise a duplicate post such that the protrusion (1200) extends from the post (1100) and connects to the duplicate post. The stretching device may further comprise a gripping handle (100) hanging down from the protrusion (1200) by a first end of a cord (500), and a weight (700) attached to a second end of the cord (500). The cord (500) may run from an attachment point (140) of the gripping handle (100), through the second cord loop (1250), through the first cord loop (1150), and attach to the weight (700) such that the weight (700) hangs from the cord (500), is capable of being lifted by pulling downwards on the gripping handle (100), and is capable of being lowered by releasing the gripping handle (100). In some embodiments, a support (1300) may extend from the post (1100) to the protrusion (1200). In some embodiments, the first cord loop (1150) is disposed on the support (1300). The stretching device may be used by a person sitting in a chair or a wheelchair underneath the protrusion (1200). The gripping handle (100) of the stretching device may aid in stretching as the gripping handle (100) does not require one to hold on as tightly as a standard handle. Use of the stretching device may provide a variety of benefits, such as rib cage elevation and increased lung capacity, both of which are useful for combating respiratory diseases. Use of the stretching device may further provide decompression of nerves in an upper thoracic region (e.g. T3 nerve roots) to further aid lung health. Use of the stretching device may further provide core stretches, which is useful in remedying posture issues. The stretching device may be especially useful to users bound to wheelchairs or with other similar physical complications.

Figure 6:
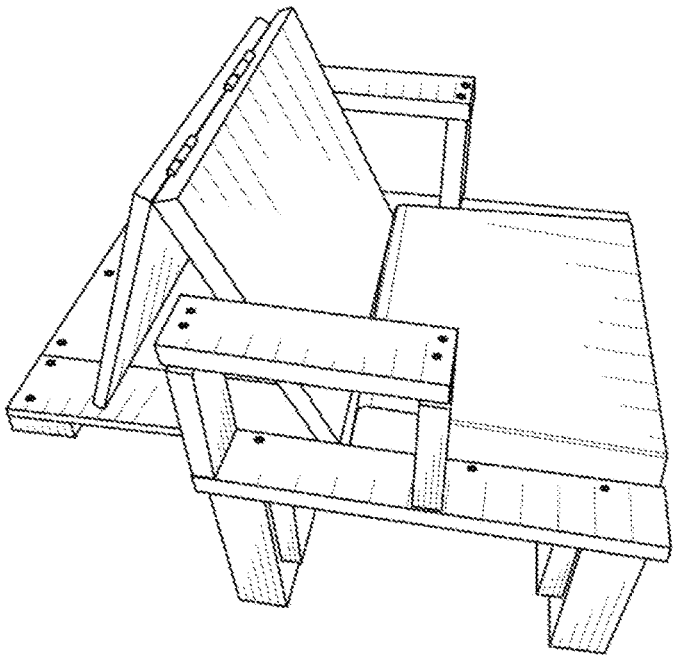
FIG. 6 shows a chair that may be used in conjunction with an embodiment of the gripping handle of the present invention.

Referring now to FIG. 6, certain devices may be compatible with the exercise and stretching devices of the present invention. For example, a device that is capable of converting between a platform for a user to lay down in a supine position on, and a chair for the user to sit upright on can be used in both the exercise and supine stretching device and the stretching device by switching the device to the correct form. The device additionally may aid in partial situp exercises, allowing users with large stomachs or recent abdominal surgery to exercise their core safely and efficiently. The exercise devices of the present invention may additionally aid in partial situp exercises.

Figure 7:
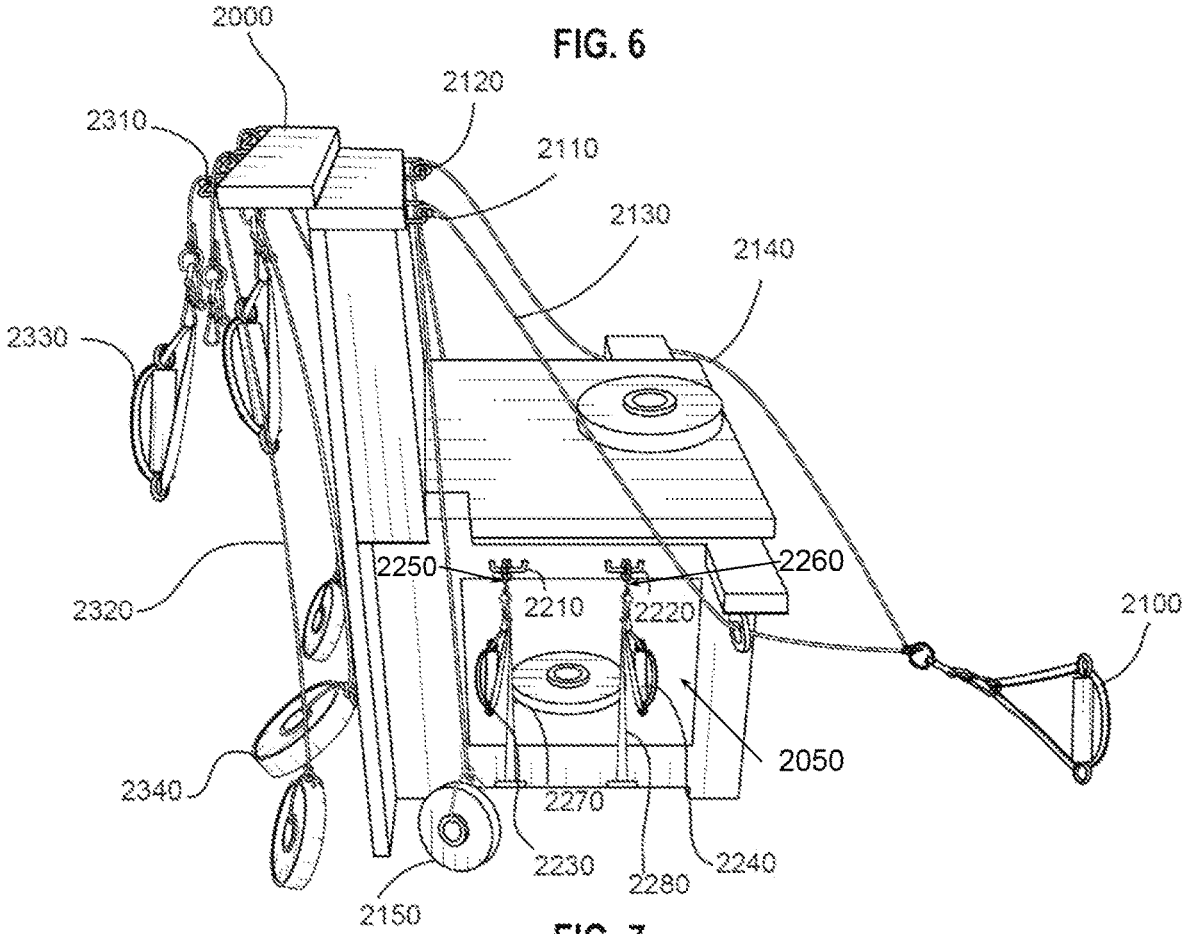
FIG. 7 shows a side view of a use case of the gripping handle of the present invention in the form of a yoga/mobile unit.
Figure 8:
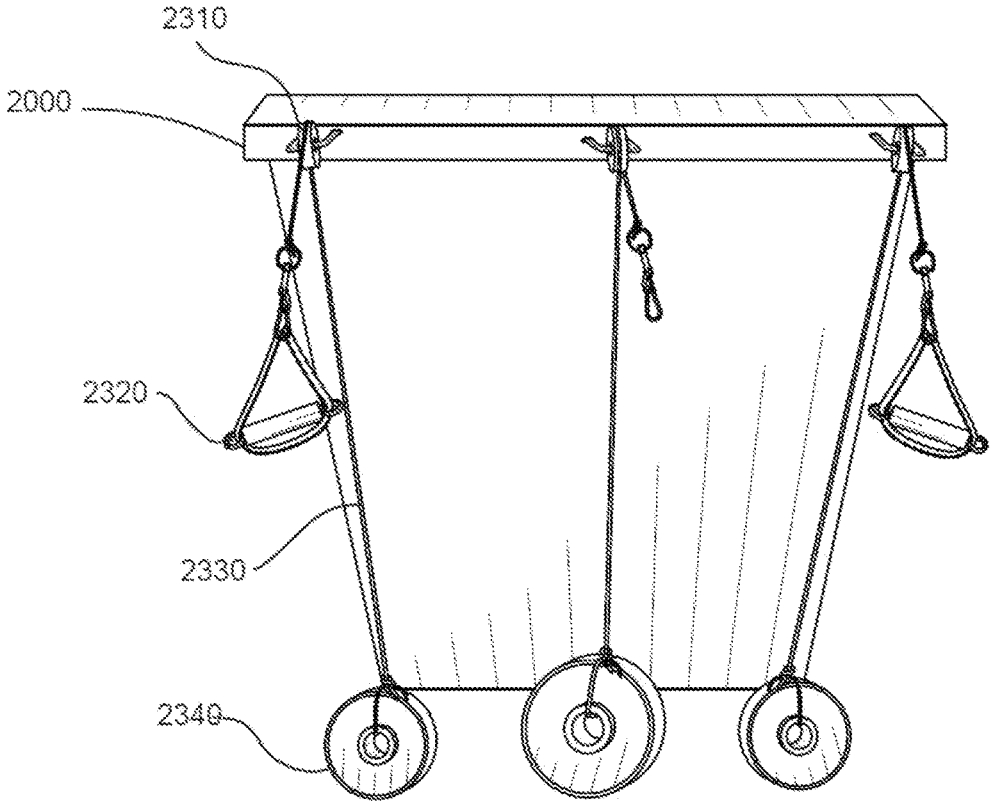
FIG. 8 shows a back view of a use case of the gripping handle of the present invention in the form of the yoga/mobile unit.

Referring now to FIGS. 7-8, the present invention features a yoga/mobile exercise device. The yoga/mobile exercise device may comprise a chair (2000). In some embodiments, the chair (2000) may have a compartment (2050) below a seat of the chair (2000). In some embodiments, the compartment (2050) may be used to store additional weights or other materials. The yoga/mobile exercise device may further comprise a first yoga/mobile pulley component (2110) and a second yoga/mobile pulley component (2120) disposed in a vertical portion of the chair (2000). In some embodiments, the yoga/mobile exercise device may further comprise a first yoga/mobile gripping handle (2100) attached to a first yoga/mobile cord (2130) and a second yoga/mobile cord (2140) such that the first yoga/mobile cord (2130) runs through the first yoga/mobile pulley component (2110) and attaches to a first yoga/mobile weight (2150) and the second yoga/mobile cord (2140) runs through the second yoga/mobile pulley component (2120) and attaches to a second yoga/mobile weight (not shown). In some embodiments, pulling on the first yoga/mobile gripping handle (2100) may cause both the first yoga/mobile weight (2150) and the second yoga/mobile weight (not shown) to lift and releasing the first gripping yoga/mobile handle (2100) may cause both the first yoga/mobile weight (2150) and the second yoga/mobile weight (not shown) to descend. The yoga/mobile exercise device may further comprise a first yoga/mobile loop (2210) and a second yoga/mobile loop (2220) disposed in an upper portion of a side of the chair (2000). The yoga/mobile exercise device may further comprise a second yoga/mobile gripping handle (2230) attached to a third yoga/mobile cord (2250) running through the first yoga/mobile loop (2210) attached to a first elastic component (2270) connected to a lower portion of the side of the chair (2000). The yoga/mobile exercise device may further comprise a third yoga/mobile gripping handle (2240) attached to a fourth yoga/mobile cord (2260) running through the second yoga/mobile loop (2220) attached to a second elastic component (2280) connected to the lower portion of the side of the chair (2000). In some embodiments, pulling on the second yoga/mobile gripping handle (2230) may cause the first elastic component (2270) to strain and pulling on the third yoga/mobile gripping handle (2240) may cause the second elastic component (2280) to strain. The yoga/mobile exercise device may further comprise a plurality of back pulley components (2310) disposed on an upper portion of the back of the chair (2000). The yoga/mobile exercise device may further comprise a plurality of back cords (2320) such that each back cord (2320) may run through a back pulley component (2310), a back gripping handle (2330) may be removably attached to a first end of each back cord (2320), and a back weight (2340) may be attached to a second end of each back cord (2320). In some embodiments, some back weights (2340) are of different sizes and weights than other back weights (2340). The yoga/mobile exercise device of the present invention may provide a plurality of different stretches and exercises using the various gripping handles disposed in the device and the associated components of the various gripping handles. In some embodiments, additional gripping handle exercise modules are disposed on the yoga/mobile exercise device for additional stretches and exercises.

Figure 9:
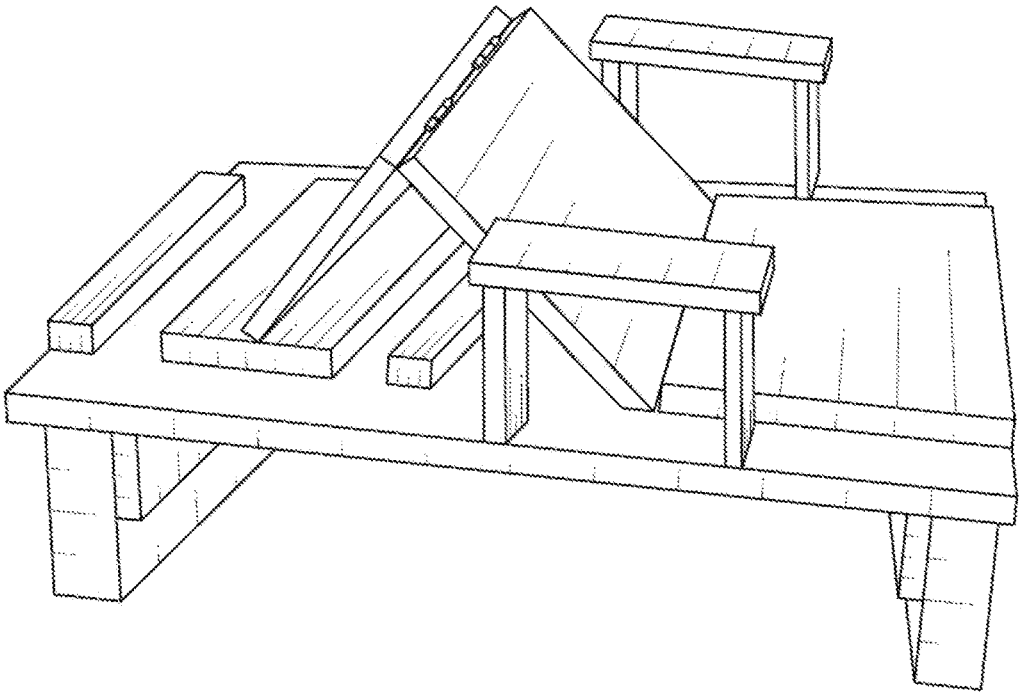
FIG. 9 shows a situp chair that may be used in conjunction with an embodiment of the gripping handle of the present invention.
Figure 10A:
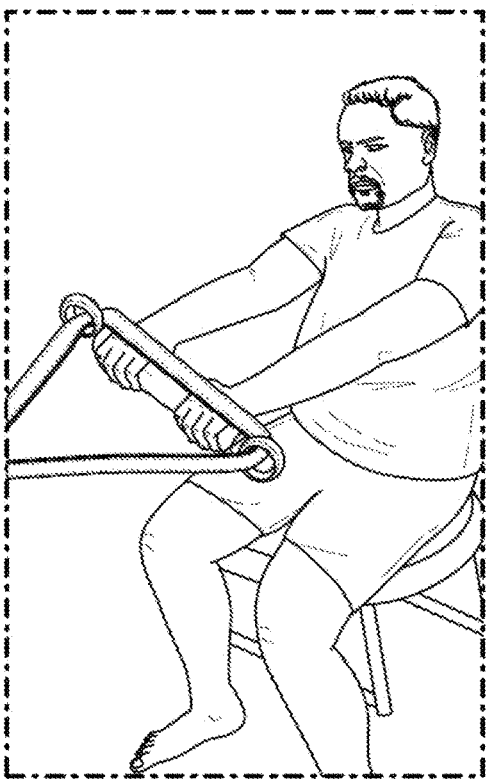
FIGS. 10A-10D show a method of executing a partial situp using an embodiment of the gripping handle of the present invention.
Figure 10B:
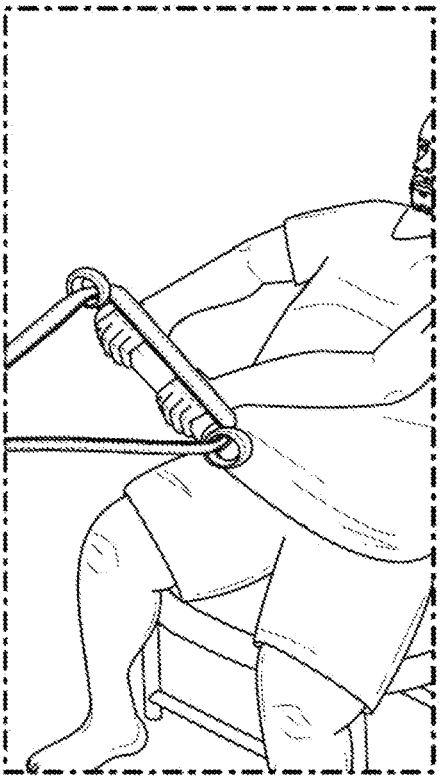
Figure 10C:
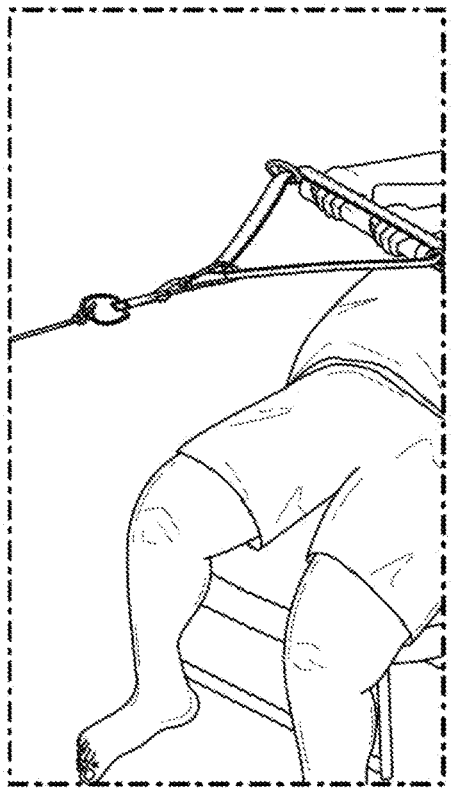
Figure 10D:
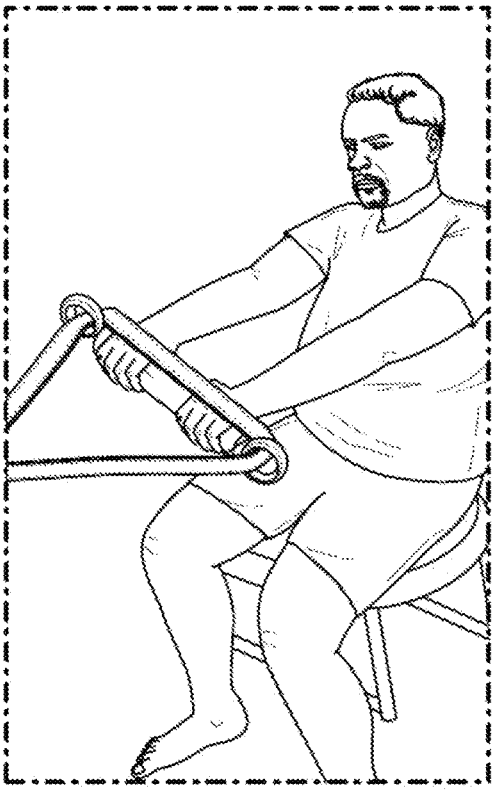

Referring now to FIG. 9, the certain devices may be compatible with the exercise and stretching devices of the present invention. For example, a device that is capable of converting between a platform state for a user to lay down in a supine position on, and a chair state for the user to sit upright on can be used in both the exercise and supine stretching device and the stretching device by switching the device to the correct form using a plurality of slots disposed on top of the device. The plurality of slots may allow the device to convert to various degrees between the platform state and the chair state. The device additionally may aid in partial situp exercises, allowing users with large stomachs or recent abdominal surgery to exercise their core safely and efficiently. The exercise devices of the present invention may additionally aid in partial situp exercises.

Referring now to FIGS. 10A-10D, an embodiment of a gripping handle of the present invention may be used to execute a partial situp. A gripping function of the gripping handle may aid a user's ability to hold onto said handle and carry out various other exercises.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A gripping handle (100), the gripping handle (100) comprising:

a. a dowel (110) having a first end and a second end;

b. a first loop (122) disposed at the first end of the dowel (110);

c. a second loop (124) disposed at the second end of the dowel (110);

d. an attachment point (150); and e. a flexible connector (130) running from the attachment point (150), through the first loop (122), along a side of the dowel (110), through the second loop (124), and back to the attachment point (150);

wherein a portion of the flexible connector (130) running along the side of the dowel (110) is configured to loop over a hand dripping the dowel (110);

wherein the portion of the flexible connector (130) is configured to loop over the hand and tighten to the hand when the dowel (110) is being pulled; and wherein the portion of the flexible connector (130) is configured to loop over the hand and loosen from the hand when the dowel (110) is not being pulled.

2. The gripping handle (100) of claim 1; wherein the flexible connector (130) comprises a leather strap.

3. The gripping handle (100) of claim 1, wherein the attachment point (150) comprises a clip attached to a cord.

4. An exercise and supine stretching device, the device comprising:

a. a gripping handle (100), the gripping handle (100) comprising:

i. a dowel (110) having a first end and a second end;

ii. a first loop (122) disposed at the first end of the dowel (110);

iii. a second loop (124) disposed at the second end of the dowel (110);

iv. an attachment point (150); and v. a flexible connector (130) running from the attachment point (150), through the first loop (122), along a side of the dowel (110), through the second loop (124), and back to the attachment point (150);

wherein a portion of the flexible connector (130) running along the side of the dowel (110) is configured to loop over a hand gripping the dowel (110);

wherein the portion of the flexible connector (130) is configured to loop over the hand and tighten to the hand when the dowel (110) is being pulled; and wherein the portion of the flexible connector (130) is configured loop over the hand and loosen from the hand when the dowel (110) is not being pulled;

b. a pulley component (300) connected to a stable surface (900);

c. a cord (500) having a first end and a second end connected to the attachment point (150) of the gripping handle (100) at the first end of the cord (500) and running through the pulley component (300); and d. a weight (700) connected to the second end of the cord (500);

wherein the weight (700) can be pulled upwards by pulling on the gripping handle (100).

5. The exercise and supine stretching device of claim 4, wherein the flexible connector (130) of the gripping handle comprises a leather strap.

6. The exercise and supine stretching device of claim 4, wherein the attachment point (150) of the gripping handle comprises a clip attached to a cord (500).

7. The exercise and supine stretching device of claim 4, wherein the device is capable of converting between a platform state for a user to lay down in a supine position on the device, and a chair state for the user to sit upright on the device.

8. The exercise and supine stretching device of claim 4 further comprising:

a. a duplicate gripping handle (200);

b. a duplicate pulley component (400);

c. a duplicate cord (600) having a first end and a second end, wherein the first end connects to the duplicate gripping handle (200) at a duplicate attachment point (250), and wherein the duplicate cord (600) runs through the duplicate pulley component (400); and d. a duplicate weight (800) connected to the second end of the duplicate cord (600);

wherein the duplicate weight (800) can be pulled upwards by pulling on the duplicate gripping handle (200).

9. The exercise and supine stretching device of claim 8, wherein the duplicate pulley component (400) connects to the stable surface (900).

* * * * *